US007281706B2

(12) United States Patent
Kinne et al.

(10) Patent No.: US 7,281,706 B2
(45) Date of Patent: Oct. 16, 2007

(54) GATHERER STITCHER

(75) Inventors: Klaus Kinne, Leipzig (DE); Andreas Steinert, Beucha (DE); Siegmar Tischer, Borsdorf (DE); Randolf Voigtländer, Colditz (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 292 days.

(21) Appl. No.: 11/039,246

(22) Filed: Jan. 18, 2005

(65) Prior Publication Data

US 2005/0158150 A1 Jul. 21, 2005

(30) Foreign Application Priority Data

Jan. 16, 2004 (DE) ..... 10 2004 002 306

(51) Int. Cl.
*B65H 5/02* (2006.01)

(52) U.S. Cl. ..... 270/52.16; 270/52.14; 270/52.18; 270/52.26; 270/52.29; 412/1; 412/2; 412/6; 412/8; 412/9; 412/25; 198/644

(58) Field of Classification Search ..... 270/52.14, 270/52.16, 52.18, 52.26, 52.29; 412/1, 2, 412/6, 8, 9, 25; 198/644
See application file for complete search history.

(56) References Cited

U.S. PATENT DOCUMENTS

| | | | | |
|---|---|---|---|---|
| 1,492,760 | A * | 5/1924 | Sproul | 198/644 |
| 1,601,802 | A * | 10/1926 | Kast | 198/644 |
| 3,807,547 | A * | 4/1974 | Mueller | 198/644 |
| 5,547,066 | A * | 8/1996 | Chang | 198/644 |
| 5,667,212 | A | 9/1997 | Merkli | |

FOREIGN PATENT DOCUMENTS

EP 0 916 514 B1 5/1999

* cited by examiner

*Primary Examiner*—Patrick Mackey
*Assistant Examiner*—Leslie A Nicholson, III
(74) *Attorney, Agent, or Firm*—Laurence A. Greenberg; Werner H. Stemer; Ralph E. Locher

(57) ABSTRACT

A gatherer stitcher having a gatherer chain configuration includes roof segments forming a ridge region and drivers having respective stop surfaces and being mounted so as to be adjustable between an operating position and a position pivotable away therefrom. An auxiliary driver is restricted to the ridge region and carried by a respective roof segment directly adjacent the stop surfaces. The auxiliary driver, in the operating position of the adjustable driver, forms a combined stop surface together with the adjustable driver.

1 Claim, 5 Drawing Sheets

GATHERER STITCHER

BACKGROUND OF THE INVENTION

FIELD OF THE INVENTION

The invention relates to a gatherer stitcher having a gatherer chain configuration, which includes roof segments forming a ridge region and drivers or entrainers having a respective stop surface and being mounted so as to be adjustable between an operating position and a position pivotable away therefrom.

A gatherer stitcher of that type is known, for example, from European Patent EP 0 916 514 B1. The gatherer stitcher disclosed therein has a gatherer chain configuration which is made up of a main gatherer chain and a secondary gatherer chain. The secondary gatherer chain and the main gatherer chain form conveyer strands extending in parallel at least along a loading section provided with folded sheet feeders. Of those conveyer strands, the strand of the main gatherer chain extends beyond a stitching station in the conveying direction at least so far that, in a transfer station, an ejector blade lifts chain signatures off the main gatherer, the chain signatures being transported straddling the gatherer chain configuration and stitched in the stitching station, and transfers those signatures to delivery belts. The conveyer strand of the secondary gatherer chain, by contrast, terminates actually before the stitching station. Disposed at equal intervals on the main gatherer chain and on the secondary gatherer chain are successive drivers or entrainers, which push in front thereof in the conveying direction signatures gathered on the gatherer chain configuration while bearing on the trailing edges thereof. Insofar as the transport of the signatures beyond the end of the conveyer strand of the secondary gatherer chain is performed by the gatherer chain configuration, that task is assumed by the main gatherer chain and the drivers thereof. The mutual spacing of the drivers or entrainers is selected in such a way that the gatherer chain configuration can accommodate, between two drivers, signatures which have a maximum processable format.

Shortly before a stitched copy having a number of signatures corresponding to the number of afore-mentioned folded sheet feeders is located in an ejection position, i.e., at least approximately assumes a centrally symmetrical position in relation to the afore-mentioned ejector blade, the driver of the main gatherer chain pushing in front of it a copy approaching the ejection position pivots away from that copy in the direction counter to the conveying direction, so that the transport along a last section of the path traced overall by the afore-mentioned copies as far as the ejection position is carried out merely under the friction between roof segments of the main gatherer chain and the copies. That last section of the path of the copies is all the greater the smaller the format of the signatures processed is, as a consequence of the centrally symmetrical position of the respective copy in relation to the ejector blade in the ejection position of the copy, which position is maintained irrespective of the format thereof. In particular, when processing signatures having a format smaller than the maximum that can be processed, there is to that extent the risk that the copies created from those signatures will change the position thereof with respect to the gatherer chain configuration in an uncontrolled manner on the last section of the path thereof to the ejection position.

The driver pushing in front thereof a copy approaching the ejection position is brought out of contact with the copy shortly before the copy arrives in the ejection position, by being pivoted counter to the conveying direction. That is done in order to counteract the risk that, as the copy is raised by the ejector blade from the assumed position thereof astride the main gatherer chain, the driver will act upon the copy in the conveying direction and, in the process, may possibly skew that copy.

SUMMARY OF THE INVENTION

It is accordingly an object of the invention to provide a gatherer stitcher which overcomes the hereinafore-mentioned disadvantages of the heretofore-known devices of this general type and which causes no uncontrolled position changes on signatures stitched by the gatherer stitcher on the path of the signatures to an ejection position.

With the foregoing and other objects in view, there is provided, in accordance with the invention, a gatherer stitcher, comprising a gatherer chain configuration, including roof segments forming a ridge region and a driver or entrainer having a respective stop surface and being mounted so as to be adjustable between an operating position and a position pivotable away therefrom. An auxiliary driver is restricted to the ridge region and carried by a respective roof segment directly adjacent the stop surfaces. The auxiliary driver, in the operating position of the adjustable driver, forms together therewith a combined stop surface.

In accordance with a concomitant feature of the invention, the adjustable driver is formed with a recess for accommodating therein the auxiliary driver in the operating position of the adjustable driver.

Thus, in accordance with the invention, provision is made for a respective roof segment immediately adjacent the stop surfaces for carrying an auxiliary driver which is restricted to the ridge region and which, in the operating position of the driver, forms a combined stop surface together with the latter.

Since a respective auxiliary driver remains in contact with a stitched copy until the latter is lifted off the roof segments of the main gatherer chain by the ejector blade, positive guidance of the copies until they are lifted off the gatherer chain configuration in the ejection position is assured.

Due to the restriction of the extent of the auxiliary drivers to the ridge region of the gatherer chain configuration, the auxiliary drivers are at least incapable of causing any permanent position changes on the copies which are lifted out. An assumed skewing as a copy is lifted off the gatherer chain configuration via an auxiliary driver would be reversed after an extremely short time, specifically before the transfer of the copy to the afore-mentioned delivery belts, due to the mass moment of inertia of the copy. Therefore, before being transferred to the delivery belts, the copy in any case rests on the ejector blade over the entire length thereof again, as it does at the instant at which the ejector blade dips into the fold.

Other features which are considered as characteristic for the invention are set forth in the appended claims.

Although the invention is illustrated and described herein as embodied in a gatherer stitcher, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
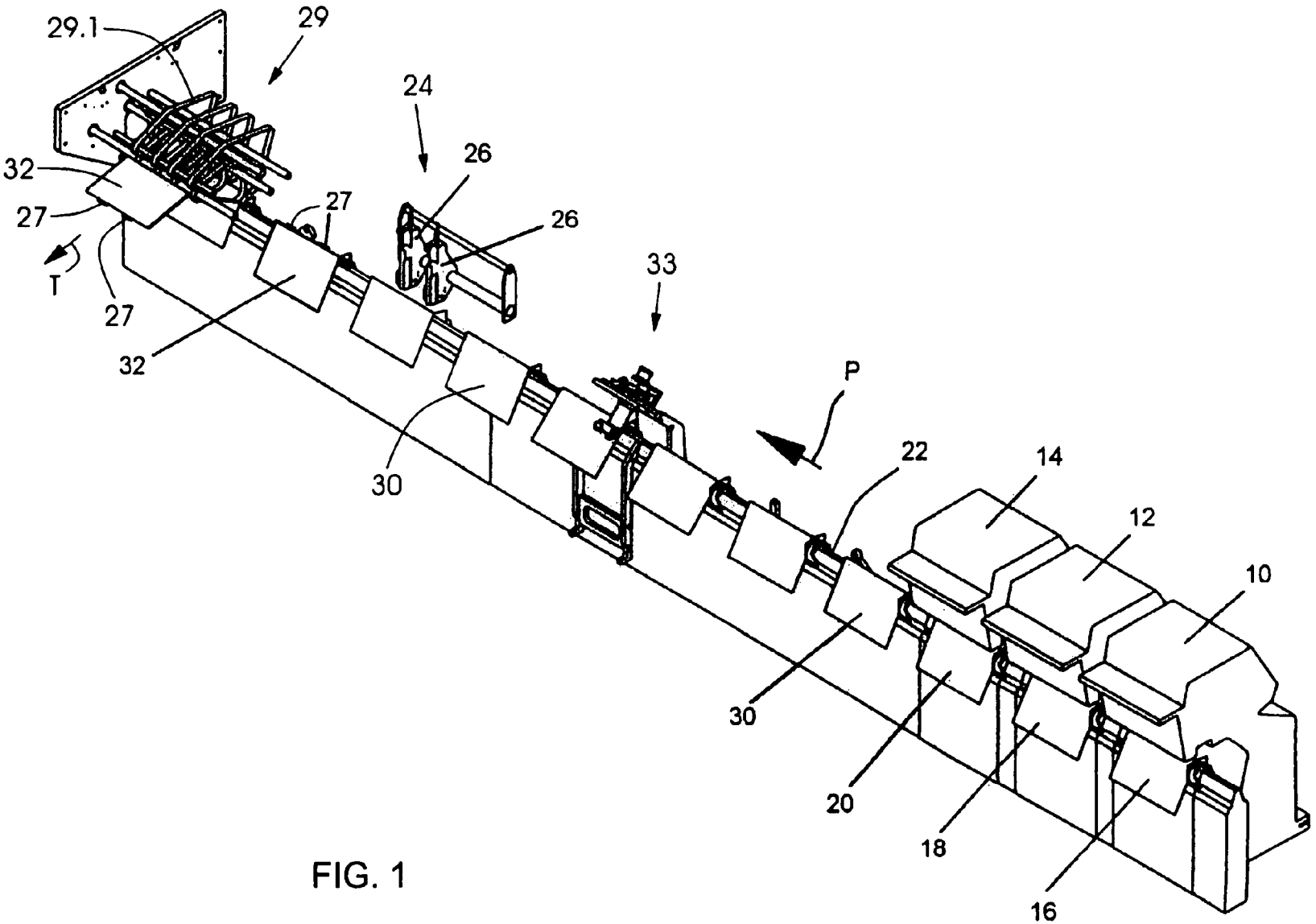
FIG. 1 is a diagrammatic, front, side and top perspective view of a gatherer stitcher.

Referring now to the figures of the drawings in detail and first, particularly, to FIG. 1 thereof, there is seen an exemplary embodiment of a gatherer stitcher according to the invention, including three folded-sheet feeders 10, 12 and 14, each of which deposits a respective folded sheet 16, 18 and 20 astride a gatherer chain configuration, that is not illustrated in detail in this figure. The folded sheets 16, 18 and 20 placed under and over one another in this way together form a copy 30 to be stitched which, just like a copy that was formed previously, is transported in a transport direction represented by an arrow P along a transport and stitching line 22, which extends along the folded sheet feeders 10, 12 and 14 and beyond a stitching station 24 as far as a transfer station 29. In this exemplary embodiment, the stitching station 24 is made up of two stitching heads 26 and benders, which are assigned to a respective one of the stitching heads 26 but are not shown in FIG. 1. The benders bend over wire staples 27 punched into the copies 30 to be stitched by the stitching heads 26, more specifically they bend over the legs of the wire staples 27 which have penetrated the copies 30.

In the exemplary embodiment of FIG. 1, the transfer station 29 includes an ejector blade, not specifically illustrated in the figure, and delivery belts 29.1. The ejector blade engages in a respective fold of stitched copies 32, lifts the stitched copies 32 out of the transport and stitching line 22 and transfers them to the delivery belts 29.1, by which the stitched copies 32 are transported farther in the direction of an arrow T, more specifically preferably to a non-illustrated trimming device.

Upstream of the stitching station 24 with respect to the transport direction represented by the arrow P, there is provided a measuring station 33. The measuring station 33, which is described in greater detail below, serves for determining the thickness of the copies 30 to be stitched.

Figure 2:
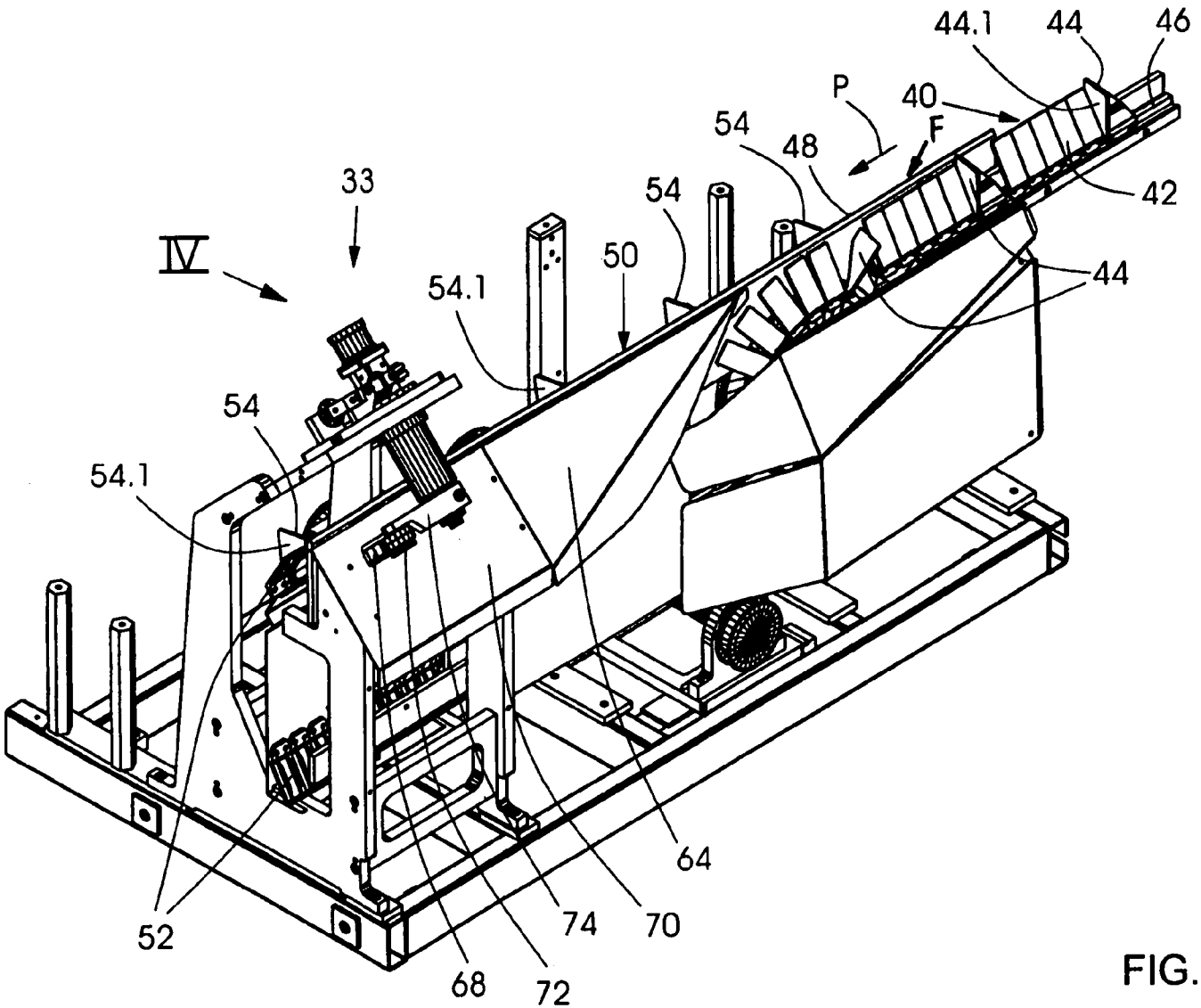
FIG. 2 is an enlarged, fragmentary, perspective view of FIG. 1, showing a stripped-down portion of the gatherer stitcher in simplified form, including a secondary gatherer chain and a main gatherer chain thereof.

As is apparent from FIG. 2, the gatherer chain configuration in the exemplary embodiment includes an endless secondary gatherer chain 40, which revolves during operation, and an endless main gatherer chain 50, which also revolves during operation. The chains 40 and 50 form conveying strands or stringers running on either side of a guide strip 48. These conveying stringers or strands pass all of the folded-sheet feeders 10, 12 and 14 together. Before reaching the measuring station 33, the secondary gatherer chain 40 dips below the guide strip 48. Further transport to the transfer station 29 of the copies 30 to be stitched as well as the copies 32 then stitched is carried out by the main gatherer chain 50 after the secondary gatherer chain 40 has dipped away.

The secondary gatherer chain 40 and the main gatherer chain 50 respectively include a roller chain that wraps around or encircles drive and deflection sprockets and has respective inner and outer chain plates, drivers or entrainers 44 and 54, disposed articulatedly at uniform intervals on the outer chain plates of one side of the chain so that they are pivotable about a roller axis of the roller chain, and also roof segments inclined transversely with respect to the roller chain. These roof segments are connected to outer chain plates of the same side of the chain. The afore-mentioned respective side of the chain and the inclination of the roof segments are provided in such a manner that the secondary gatherer chain 40 and the main gatherer chain 50 jointly constitute a pitched roof forming a ridge region F along the conveying stringer or strand of the secondary gatherer chain 40. A gap, which is bridged by the guide strip 48, is formed in the ridge region F.

The mutual spacings of the drivers 44 of the secondary gatherer chain 40 are equal to those of the drivers 54 of the main gatherer chain 50, and the phase angle of the secondary gatherer chain 40 and of the main gatherer chain 50 is set in such a manner that stop surfaces 44.1 and 54.1 formed on the drivers 44 and on the drivers 54 and extending in the transport direction represented by the arrow P are flush along the conveying stringer or strand of the secondary gatherer chain 40, specifically until, before the secondary gatherer chain 40 dips away, a respective driver 44 of the secondary gatherer chain 40 pivots away from this copy 30 from an operating position, wherein it pushes a copy 30 in front of itself, counter to the transport direction represented by the arrow P. This pivoting of the drivers 44 and 54 takes place under the inherent weight thereof, which is supported by guide rails in the operating position of the drivers 44 and 54.

Figure 3:
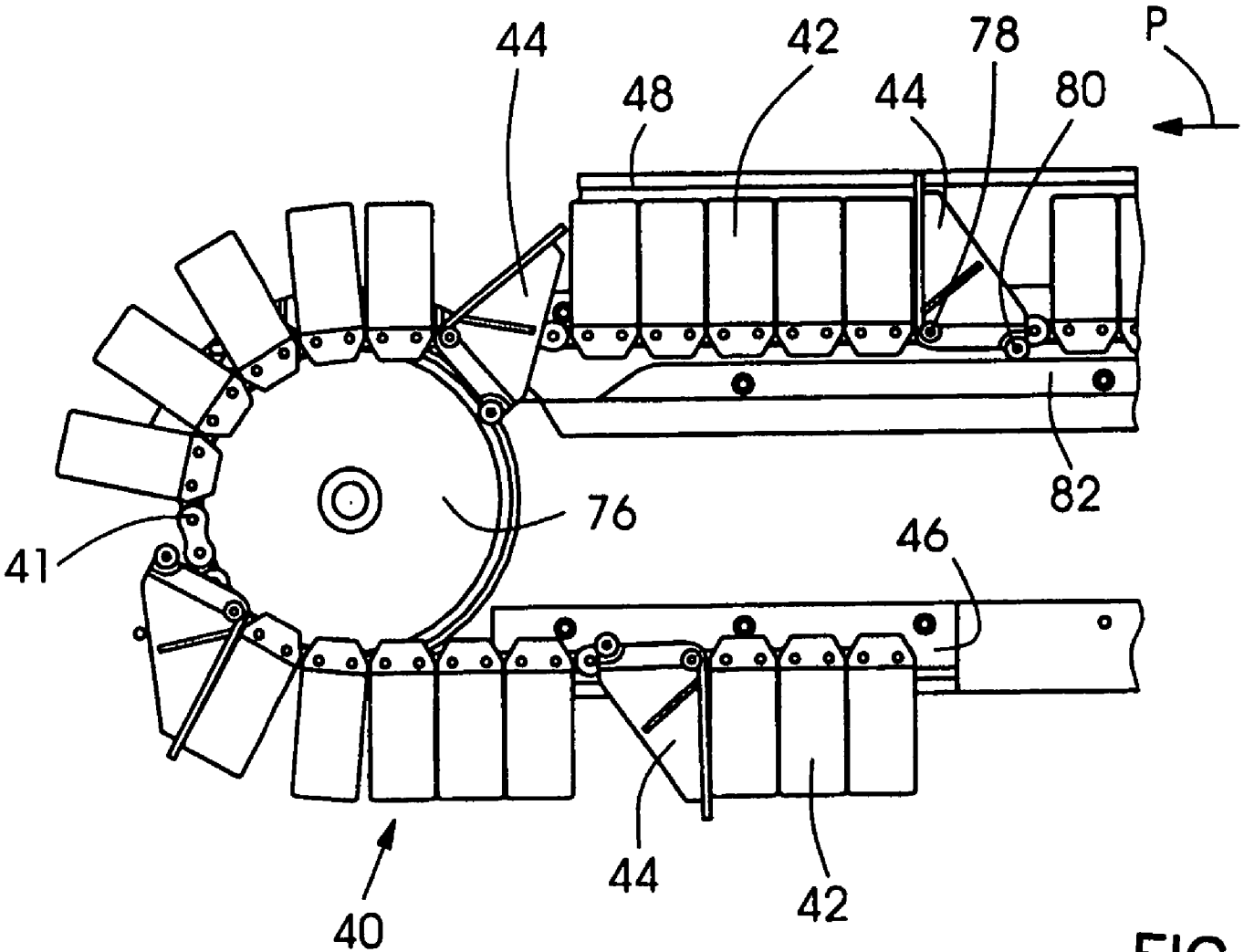
FIG. 3 is an enlarged fragmentary view of FIG. 2 primarily reproducing a section of the secondary gatherer chain and a deflection region thereof.

This is shown in FIG. 3, using the secondary gatherer chain 40 by way of example. The principle represented therein applies as well to the main gatherer chain 50 and the drivers or entrainers 54 thereof.

An endless roller chain 41 which serves for forming the secondary gatherer chain 40 wraps or is slung around a drive sprocket 76 and a deflection sprocket, that is not illustrated in FIG. 3, and is guided therebetween by guide rails 46. A respective one of the drivers 44 is coupled to the roller chain 41 via an articulated connection 78 so that it is pivotable about the axis of one of the chain rollers of the roller chain 41. In the embodiment according to FIG. 3, a respective driver 44 is supported on a guide rail 82 along the transport strand of the secondary gatherer chain 40 by a cam follower roller 80 and, as a result, is maintained in the operating position thereof. Shortly before a respective driver 44 reaches the drive sprocket 76, the supporting action of the guide rail 82 is removed (a guide surface formed on the guide rail 82 and maintaining the drivers 44 in the operating position thereof diverts the cam follower roller 80), and the driver 44 pivots, counter to the transport direction represented by the arrow P, away from the copy 30 to be stitched in the case of the embodiment of FIG. 1, respectively pushed forward by the driver 44.

As mentioned above, the principle explained to this extent for changing the position of the drivers 44 from the operating position thereof into a position pivoted away from the latter also applies to the drivers 54 of the main gatherer chain 50 but with the difference that the drivers 54 of the latter pivot out of the operating position thereof when they have approached within a specific distance of the aforementioned ejector blade.

As may further be seen in FIG. 2, guide plates 64 and 70 are provided, in particular following the secondary gatherer chain 40 which dips away. These guide plates 64 and 70 respectively support and guide one leg of the copies 30 being transported onward astride. The respective other leg thereof is supported and guided by roof segments 52 of the main gatherer chain 50. Accordingly, the guide plates 64 and 70 are disposed inclined in exactly the same manner as roof segments 42 of the secondary gatherer chain 40 and, together with roof segments 52 of the main gatherer chain 50, they form a pitched roof having a ridge region, wherein once again a gap is formed, which is bridged by the above-mentioned guide strip 48.

The above-mentioned measuring station 33 includes a fixed measuring roller 68 inserted into a recess formed in the guide plate 70, and an outwardly movable measuring roller 72 which is carried by a sensing arm 74. The copies 30 to be stitched pass the measuring station 33 between the fixed measuring roller 68 and the outwardly movable measuring roller 72.

As explained above, in the afore-mentioned transfer station 29, the stitched copies 32 are lifted out of the transport and stitching line 22 by the afore-mentioned ejector blade and are transferred to the delivery belts 29.1. The transport of the stitched copies 32 preceding this operation in the instant exemplary embodiment is carried out exclusively by the main gatherer chain 50. To this extent, the measures for preventing uncontrolled position changes of the stitched copies on the path thereof to the ejection position thereof are restricted to the main gatherer chain 50 in the instant exemplary embodiment. However, it is believed to be readily apparent that, assuming a configuration of a gatherer stitcher so that the latter transports stitched copies by two gatherer chains as far as the transfer position, the corresponding measures can be taken on both gatherer chains.

Figure 4A:
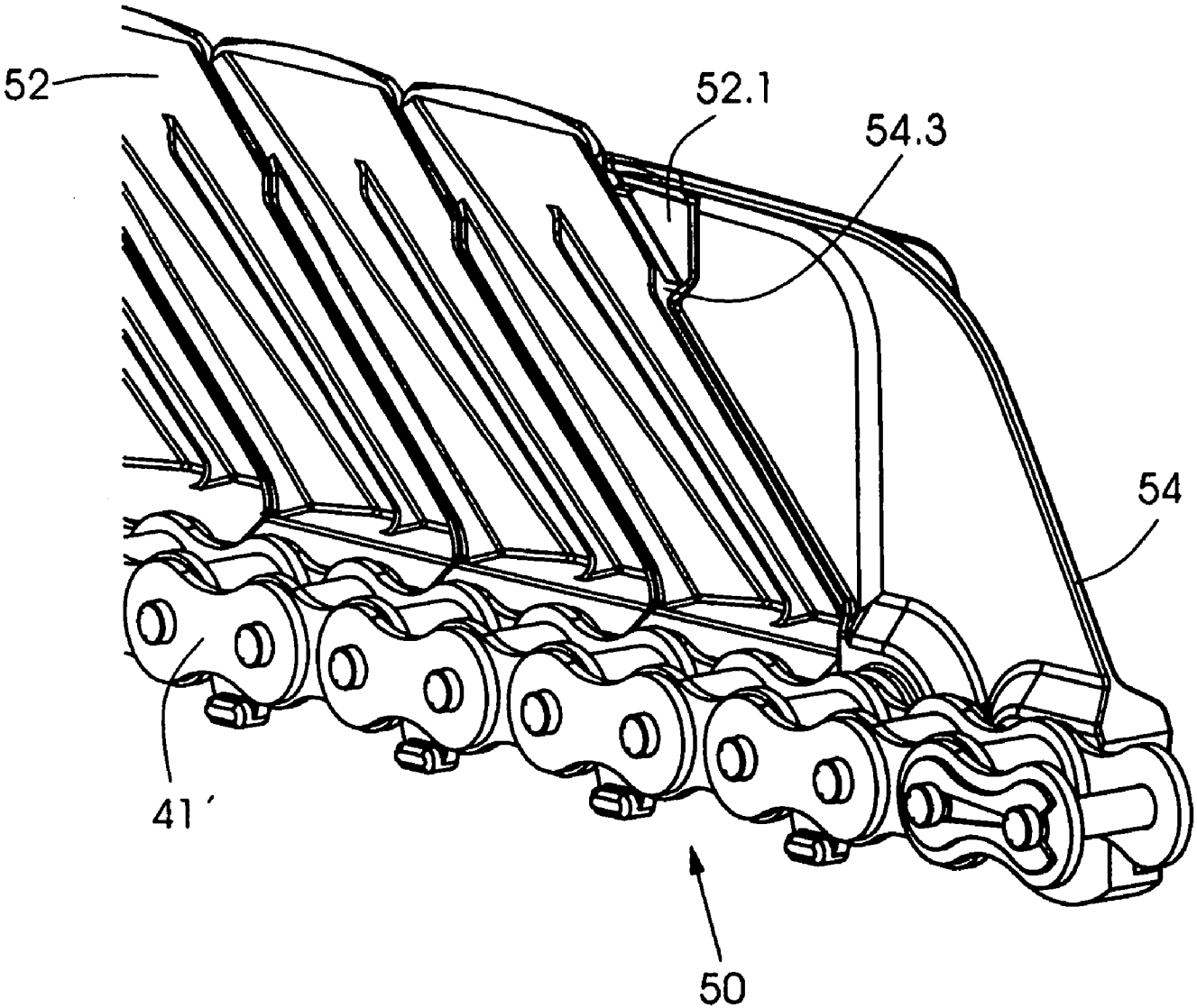
FIG. 4A is another enlarged fragmentary view of FIG. 2 showing a section of the main gatherer chain as viewed in a direction opposite to that represented by an arrow IV.
Figure 4B:
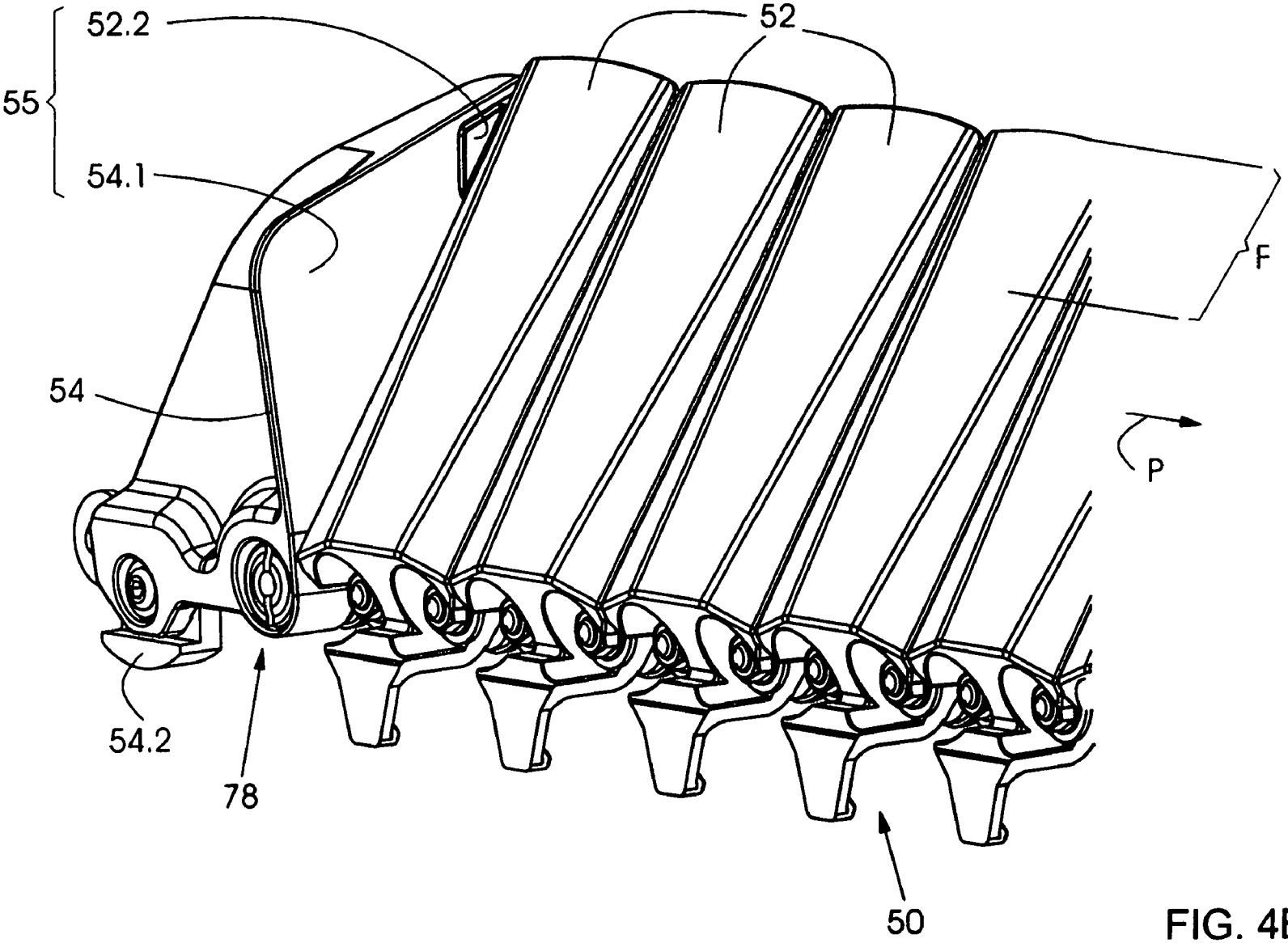
FIG. 4B is a further enlarged fragmentary view of FIG. 2 showing a section of the main gatherer chain as viewed in a direction represented by the arrow IV.

Illustrated in FIGS. 4A and 4B is a section of the main gatherer chain 50 affected by the afore-mentioned measures in the case at hand and, in fact, shown in FIG. 4A in the installed position thereof, as is readily apparent from FIG. 2 particularly.

The main gatherer chain 50 is formed by an endless roller chain 41', on the chain links of which, formed by outer chain plates. The roof segments 52 are disposed in the manner described above.

A section of the main gatherer chain 50 corresponding to FIG. 4A, as viewed in the direction of an arrow IV in FIG. 2, is represented in an enlarged perspective view in FIG. 4B. The section illustrated in FIG. 4B includes a plurality of roof segments 52 and one of the above-mentioned drivers 54 which, in a manner analogous to the configuration of the secondary gatherer chain 40, is disposed via an articulated connection 78 on the endless roller chain 41' provided for forming the main gatherer chain 50, and is held in the afore-mentioned operating position by a cam follower, formed alternatively in relation to the cam follower roller 80 according to FIG. 3 in the form of a sliding shoe 54.2, and a guide rail, not illustrated in FIG. 4B, supporting the sliding shoe 54.2. This operating position is illustrated in FIGS. 4A and 4B.

A respective roof segment 52 immediately adjacent a stop surface 54.1 of one of the drivers 54 bears an auxiliary driver or entrainer 52.1 restricted to the ridge region F mentioned above. This auxiliary driver 52.1 forms an auxiliary stop surface 52.2 which is directed in the transport direction represented by the arrow P and which, in the operating position of the driver 54, forms together with the stop surface 54.1 of the driver 54, a combined further stop surface 55. In this regard, the auxiliary stop surface 52.2 of the auxiliary driver 52.1 and the stop surface 54.1 of the driver 54 preferably lie in one and the same preferably vertically extending plane in the operating position of the driver 54.

The auxiliary drivers 52.1, in a first configuration, are integrally molded in one piece on respective roof segments 52 and, in a second configuration, are detachably connectible therewith. In the first case, in the event of a change in the mutual spacings of the drivers 54 of the main gatherer chain 50 (and therefore of the drivers 44 of the secondary gatherer chain 40), the so-called chain pitch, in order to adapt or adjust to different formats of the copies 32, amongst others roof segments 52 with and without auxiliary drivers 52.1 have to be mutually interchanged, whereas in the second case, in order to adapt to different formats of the copies 32, amongst others, changed numbers of drivers 52 with auxiliary drivers 52.1 have to be provided.

As shown in FIG. 4A, in the respective driver 54, a recess 54.3 is provided, which accommodates the respective auxiliary driver 52.1 in the operating position of the driver 54.

This application claims the priority, under 35 U.S.C. § 119, of German Patent Application DE 10 2004 002 306.9, filed Jan. 16, 2004; the entire disclosure of the prior application is herewith incorporated by reference.

We claim:

1. A gatherer stitcher, comprising a gatherer chain configuration, including:

roof segments forming a ridge region;

drivers having respective stop surfaces and being adjustably mounted between an operating position and a position pivotable away from said operating position;

an auxiliary driver restricted to said ridge region and carried by a respective roof segment directly adjacent said stop surfaces;

said drivers each being formed with a respective recess for accommodating said auxiliary driver in said recess in said operating position of said drivers; and said auxiliary driver, in said operating position of said drivers, forming a combined further stop surface together with respective ones of said drivers.

* * * * *